US006653610B2

(12) United States Patent
Ahn

(10) Patent No.: US 6,653,610 B2
(45) Date of Patent: Nov. 25, 2003

(54) ELECTRIC OUTFIT ROOM IN MICROWAVE OVEN

(75) Inventor: Seong Soon Ahn, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/984,066

(22) Filed: Oct. 26, 2001

(65) Prior Publication Data

US 2002/0084265 A1 Jul. 4, 2002

(30) Foreign Application Priority Data

Dec. 28, 2000 (KR) ..... 2000-36860 U

(51) Int. Cl.[7] ..... H05B 6/80; H05B 6/66
(52) U.S. Cl. ..... 219/756; 219/757; 219/746
(58) Field of Search ..... 219/756, 757, 219/746, 748

(56) References Cited

U.S. PATENT DOCUMENTS

| | | | | | |
|---|---|---|---|---|---|
| 4,184,945 | A | * | 1/1980 | Morgan et al. | 219/757 |
| 4,282,416 | A | * | 8/1981 | White | 219/756 |
| 4,313,043 | A | * | 1/1982 | White et al. | 219/756 |
| 4,314,126 | A | | 2/1982 | Yoshimura et al. | 219/10.55 R |
| 4,327,274 | A | | 4/1982 | White et al. | 219/10.55 R |
| 4,618,756 | A | * | 10/1986 | Schwaderer et al. | 219/757 |
| 5,017,750 | A | * | 5/1991 | Igarashi | 219/756 |
| 5,442,161 | A | * | 8/1995 | Matsushima | 219/756 |
| 5,594,207 | A | * | 1/1997 | Fabian et al. | 174/58 |
| 6,218,654 | B1 | | 4/2001 | Braunisch | 219/757 |
| 6,278,099 | B1 | | 8/2001 | Kang | 219/757 |

FOREIGN PATENT DOCUMENTS

| | | | | |
|---|---|---|---|---|
| EP | 0 110 364 | * | 6/1984 | 219/756 |
| JP | 58-203322 | * | 11/1983 | 219/756 |
| JP | 3-133086 | * | 6/1991 | 219/756 |

* cited by examiner

*Primary Examiner*—Philip H. Leung
(74) *Attorney, Agent, or Firm*—Fleshner & Kim, LLP

(57) ABSTRACT

A microwave oven is provided which allows electrical components to be cooled separately from the cooking chamber. The microwave oven includes a front plate and a back plate which is spaced a distance from, and opposite to the front plate. The microwave oven also includes a base plate between the front plate and the back plate, and a partition wall for isolating a cooking chamber from an electric outfit room. A wave guide is attached to a rear part of the partition wall and a magnetron is mounted on an upper surface of the wave guide. An electric outfit plate is fitted at approximately the same height as the upper surface of the cooking chamber. Electrical components such as a transformer and a capacitor can be mounted on the electric outfit plate. With this arrangement, the electric components are all mounted above and to the side of the cooking chamber, which allows them to be easily cooled.

20 Claims, 8 Drawing Sheets

ELECTRIC OUTFIT ROOM IN MICROWAVE OVEN

BACKGROUND OF THE INVENTION

1. Field of the Invention

The present invention relates to a microwave oven, and more particularly, to an improved electric outfit room having electric fittings provided therein for generation of a microwave.

2. Background of the Related Art

The microwave oven is a cooker in which a magnetron is used for generating, and permeating the microwave into a cooking object, to cause molecular movement therein for heating the cooking object, and recently, a microwave oven has appeared, which has a function of a cooker of its own as well as a ventilator for removal of heat, gas, and food smell generated at a gas oven range. In general, such a type of microwave oven is installed over a gas oven range, so as to be called as an OTR (Over-the-Range) type microwave oven.

A related art OTR type microwave oven will be explained briefly, with reference to FIGS. 1 and 2. In general, the gas oven range 200 is fitted between of kitchen sinks 600, over which cupboards 400 are fitted. The microwave oven 100 is fitted between the cupboards 400.

The related art OTR type microwave oven 100 is provided with a door part of a door and a control panel, a vent grill 160 above the door part, a cavity assembly 100*a* in rear of the door part, an air duct 506 above the cavity assembly 100*a*, and an out case covering the cavity assembly 100*a* and the air duct 506. The cavity assembly 100*a* is provided with a front plate 110 of a front face of a cavity 1000, a back plate 120 of a rear face of the cavity 1000, and a base plate 130 fitted between bottoms of the front plate 110 and the back plate 120. A space formed between the front plate 110 and the back plate 120 is divided by a partition wall 'T' into the cavity 1000 for cooking food therein and an electric outfit room for fitting electric components therein. That is, in the electric outfit room 300, there is a magnetron 500 fitted to the partition wall 'T' for generating a microwave, a high voltage transformer 502 fitted to the back plate 120, a high voltage capacitor 503 on the base plate 130, a floor of the electric outfit room 300, and a cooling fan 520, a suction guide 510, and a fan-motor assembly on one side of the front plate 110. The high voltage transformer 502 may be fitted to a bottom of the base plate 130. There is a vent motor 516 fitted to an upper surface 140 of the cavity 1000 near to the back plate 120, on both sides of which sirocco fans 517 are fitted. There are suction holes 131 in right and left part of the back plate 130 for drawing heat and smoke from the gas oven range 200 below the microwave oven 100.

The ventilation by the foregoing related art OTR type microwave oven will be explained with reference to FIGS. 1 and 2, briefly.

In order to discharge the heat and the smoke from the gas oven range 200 below the related art OTR type microwave oven 100 (called as "microwave oven"), the microwave oven 100 draws the heat and the smoke from the gas oven range 200 through the suction holes 131 in both sides of the base plate 130 of the microwave oven when the vent motor 516 fitted to the upper surface of the cavity 1000 comes into operation, which reaches to the sirocco fans 517 coupled to a shaft of the vent motor 516 along a discharge passage formed by the air guide 512. Then, the heat and smoke reached to the sirocco fan 517 is drawn into the sirocco fan 517 in an axial direction, and discharged perpendicular to the axial direction, and discharged to outside of the microwave oven through a cleaning filer (not shown) and the vent grill 160.

In the meantime, during cooking, the microwave oven is required to reject heat for normal operation because smoke and heat is generated in the cavity 1000, and heat is generated at the magnetron 500, the high voltage transformer 502, and the high voltage capacitor 503. To do this, the cooling fan 520 in the electric outfit room 300 is operated, to draw air through one side of the vent grill 160 into the electric outfit room along the air duct 506, and, therefrom, to circulate from a front of the cooling fan 520 to rear of the cooling fan 520,and to escape toward the cavity 1000, a cooking chamber, through a vent hole 151 in the partition wall 'T'. The air introduced into the cavity 1000 escapes through a discharge hole 141 in a top surface of the cavity 1000, and discharged to outside of microwave oven through the vent grill 160. In the process of such an air flow, the heat generated at the electric outfit in the electric outfit room 300 is rejected, and the heat, smoke, food smell, and the like produced in the cooking chamber are discharged.

However, the foregoing microwave oven has the following structural problems.

The related art microwave oven 100 requires a separate cooling fan 520 for cooling down the high voltage transformer 502 and the high voltage capacitor 503 because electric components, such as the high voltage transformer 502 and the high voltage capacitor 503, are fitted to a lower part of the electric outfit room 300. The provision of the separate cooling fan 520 for cooling down the electric outfit room 300 causes to require the air guide 512 for isolating the electric outfit room 300 from the heat and smoke form the gas oven range 200, and the vent hole 151 in one side of the cavity 1000 for leading the air introduced into the electric outfit room 300 toward the cavity. According to this, a number of components, and required man-power are increased, and a structure of the electric outfit room 300 becomes complicate. Along with this, a structure of the air duct 506 in rear of the vent grill 160 for introduction of an external air into the electric outfit room 300 becomes complicate.

SUMMARY OF THE INVENTION

Accordingly, the present invention is directed to an electric outfit room in a microwave oven that substantially obviates one or more of the problems due to limitations and disadvantages of the related art.

An object of the present invention is to provide an electric outfit room in a microwave oven, in which a cooling fan and an air guide are eliminated, and structures of the air duct and the cavity are simplified, for reducing required number of components, and man power, and material cost in the fabrication, and improving a productivity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electric outfit room in a microwave oven includes a cavity assembly, and a partition wall for isolating a cavity from an electric outfit room, the cavity assembly having a front plate of a cavity, a back plate of the cavity in rear of, spaced a distance from, and opposite to, the front plate, and a base plate between the front plate and the back plate, and the cavity being formed between the front plate and the back plate for cooking food therein, wherein the electric outfit room has a wave guide vertically fitted to a rear part of the partition wall, having a magnetron fitted on an upper surface of the wave guide, and an electric outfit plate fitted at a height the same with the upper surface of the cavity.

The electric outfit plate includes a front surface and a rear surface fitted to the front plate and the back plate respectively, for fitting electric outfits, such as a high voltage transformer and a high voltage capacitor, on the electric outfit plate.

The wave guide includes a supporting member between the front plate and the back plate for supporting the wave guide under the wave guide.

The supporting member includes one end fixed to the front plate and the other end fixed to the back plate.

The supporting member has a hole at a position in correspondence to a fastening hole in an edge surface of the wave guide for fastening a bolt for fitting the wave guide, firmly.

In other aspect of the present invention, there is provided an electric outfit room in a microwave oven including a cavity assembly, and a partition wall for isolating a cavity from an electric outfit room, the cavity assembly having a front plate of a cavity, a back plate of the cavity in rear of, spaced a distance from, and opposite to, the front plate, and a base plate between the front plate and the back plate, and the cavity being formed between the front plate and the back plate for cooking food therein, wherein the electric outfit room has a wave guide vertically fitted to a rear part of the partition wall, having a magnetron fitted on an upper surface of the wave guide, a front support rail and a rear support rail fitted to the front plate and the back plate for fitting an electric outfit plate at a height the same with the upper surface of the cavity in the electric outfit room, and an electric outfit plate having the electric outfits fitted thereon for inserting in the microwave oven from a side thereof slid on the front support rail and the rear support rail.

The electric outfit plate includes a cut out area 'C' in one corner, and a down set supporting part around the cut out area 'C' for supporting the edge surface of the wave guide in a state insertion of the electric outfit plate along the supporting rails is completed.

The down set supporting part in the electric outfit plate has a fastening hole in correspondence to a fastening hole formed in the edge surface of the wave guide, for fastening the electric outfit plate to the wave guide.

The supporting rails are provided to the front plate of the cavity and the back plate of the cavity, respectively.

The electric outfit plate is fitted to a height similar to the vent motor fitted to an upper surface of the cavity.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
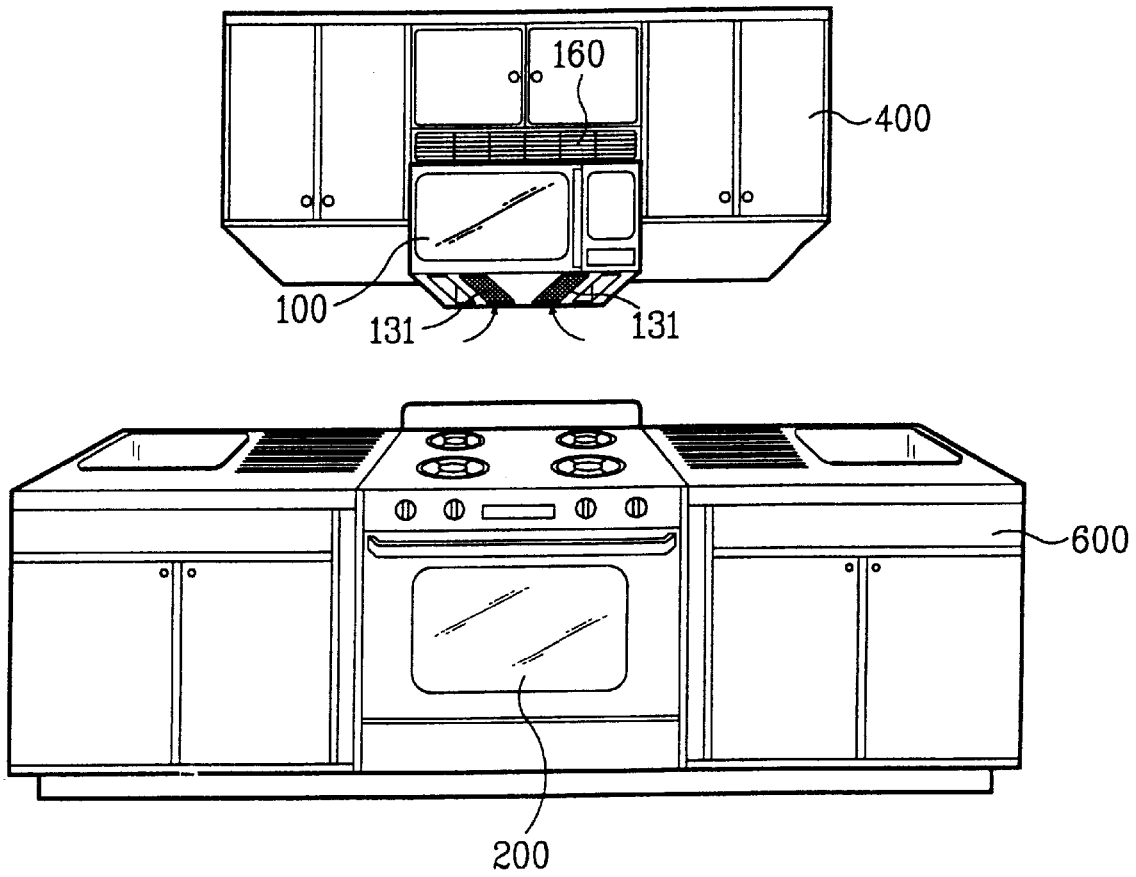
FIG.1 PRIOR ART
FIG. 1 illustrates a perspective view of a kitchen having a related art OTR type microwave oven fitted therein.
Figure 2:
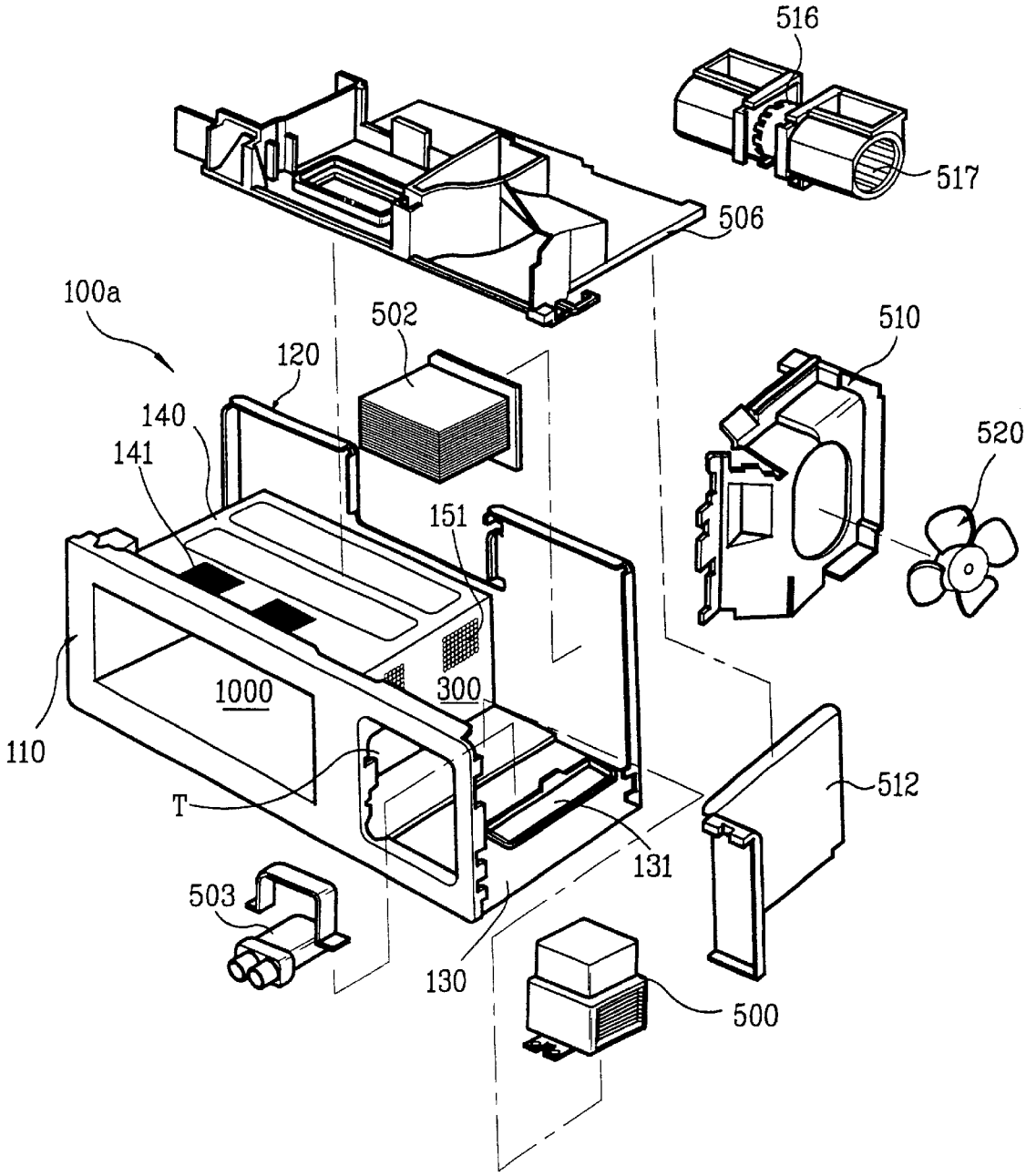
FIG. 2 PRIOR ART
FIG. 2 illustrates a perspective, disassembled view of the related art OTR type microwave oven.
Figure 3:
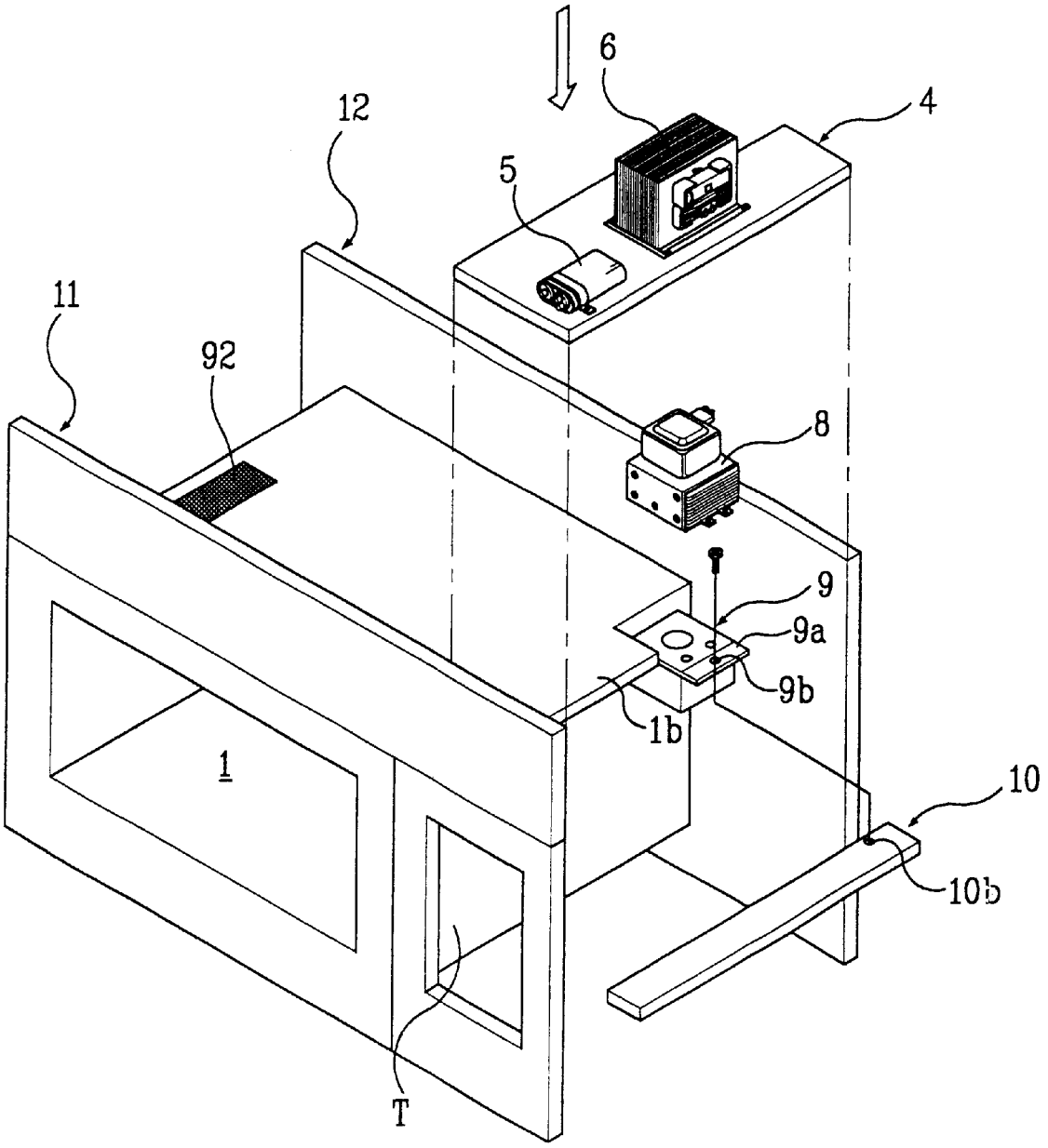
FIG. 3 illustrates a perspective, disassembled view of a structure of an electric outfit room in an OTR type microwave oven in accordance with a first preferred embodiment of the present invention.
Figure 4:
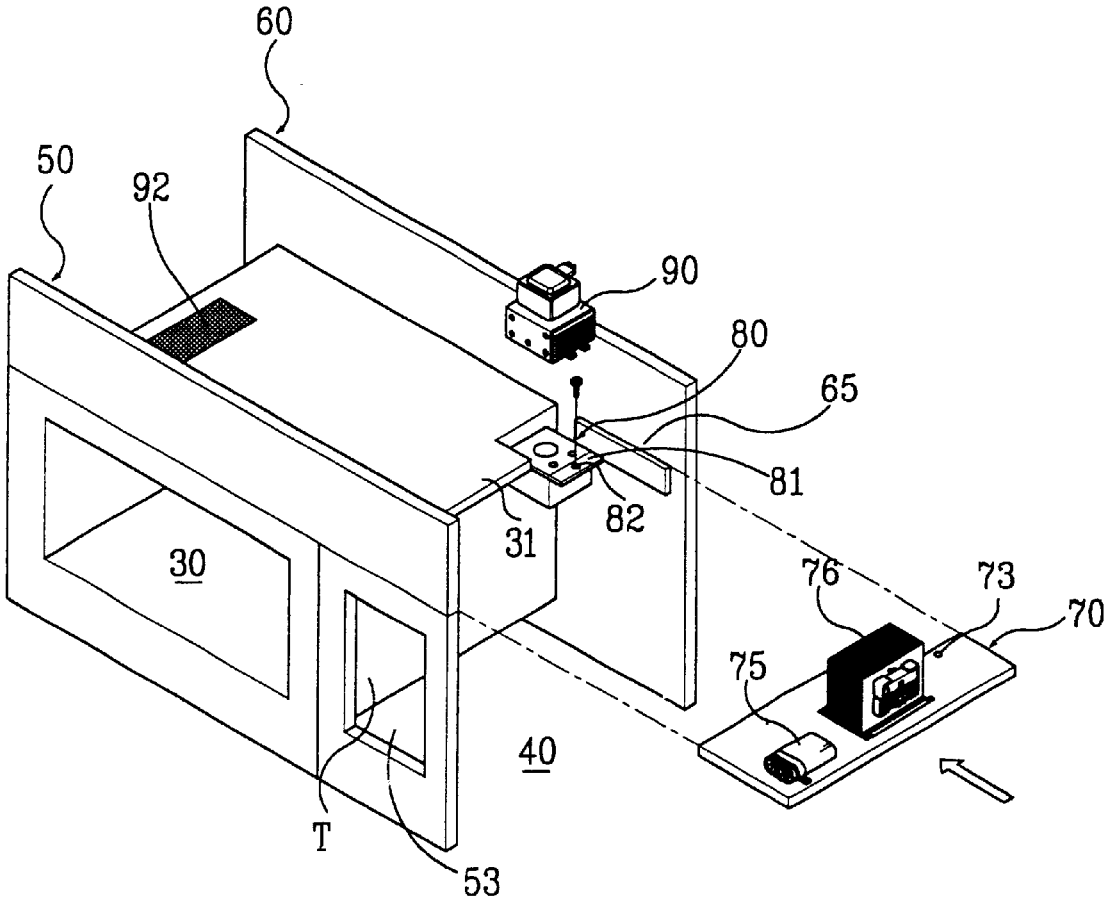
FIG. 4 illustrates a perspective, disassembled view of a structure of an electric outfit room in an OTR type microwave oven in accordance with a second preferred embodiment of the present invention.

Reference will now be made in detail to the preferred embodiments of the present invention, examples of which are illustrated in the accompanying drawings. An electric outfit room in accordance with a first preferred embodiment of the present invention will be explained, with reference to FIGS. 3 and 8. FIG. 3 illustrates a perspective, disassembled view of a structure of an electric outfit room in an OTR type microwave oven in accordance with a first preferred embodiment of the present invention.

Referring to FIG. 3, the electric outfit room in an OTR type microwave oven in accordance with a first preferred embodiment of the present invention includes a cavity assembly 100*a* having a front plate 11, a back plate 12 in rear of, spaced a distance from, and opposite to, the front plate 11, and a base plate between the front plate 11 and the back plate 12, and a partition wall 'T' for isolating a cavity 1 formed between the front plate 11 and the back plate 12 for cooking food therein from an electric outfit room 3, wherein the electric outfit room further includes a wave guide 9 vertically fitted to a rear part of the partition wall 'T', a magnetron 8 fitted on an upper surface of the wave guide 9, and an electric outfit plate 4 fitted at a height in the electric outfit room 3 the same with the upper surface of the cavity. The electric outfit plate 4 has a front surface fitted to the front plate 11, and a rear surface fitted to a back plate 12, with electric outfits, such as the high voltage transformer 6 and the high voltage capacitor 5, fitted thereon. There is a wave guide supporting member under the wave guide 9 between the front plate 11 and the back plate 12. One end of the supporting member 10 is fixed to the other end of the front plate 11, and the other end of the supporting member 10 is fitted to the back plate 12. The supporting member 10 has an opening 10*b* at a position opposite to a fastening hole 9*b* in an edge surface 9*a* of the wave guide for fastening bolts, for firm fastening of the wave guide 9 thereto. There is a vent motor 91 fitted on the upper surface 1*b* of the cavity having two sirocco fans coupled thereto in a back plate direction 12, so that one side sirocco fan rejects heat from the electric outfit room 3, and the other side sirocco fan draws, and discharges smoke and heat coming up from a cooker below.

A process for assembling the foregoing electric outfit room of the present invention will be explained.

At first, the wave guide 9 is vertically welded to the partition wall 'T' in the vicinity of the vent motor 91. Then, the supporting member 10 is placed under the edge surface 9*a* of the wave guide 9, such that the fastening hole 9*b* in the edge surface 9*a* of the wave guide 9 is aligned with the opening 10*b* in the supporting member 10, and the one end and the other end of the supporting member 10 are welded to the front plate 11 and the back plate 12. Then, a bolt is fastened through the fastening hole 9*b* in the edge surface 9*a* of the wave guide 9 and the opening 10*b* in the supporting member 10, for fitting the wave guide 9, more firmly. Then, the magnetron 8 is fitted on a top surface of the wave guide 9. Finally, the electric outfit plate 4 having the high voltage transformer 6 and the high voltage capacitor 5 fitted thereon is inserted from above the microwave oven to an upper part of the electric outfit room 3, and fastened by bolts at a height the same with the upper surface 1*b* of the cavity, to complete an assembly process of the electric outfit room.

Figure 8:
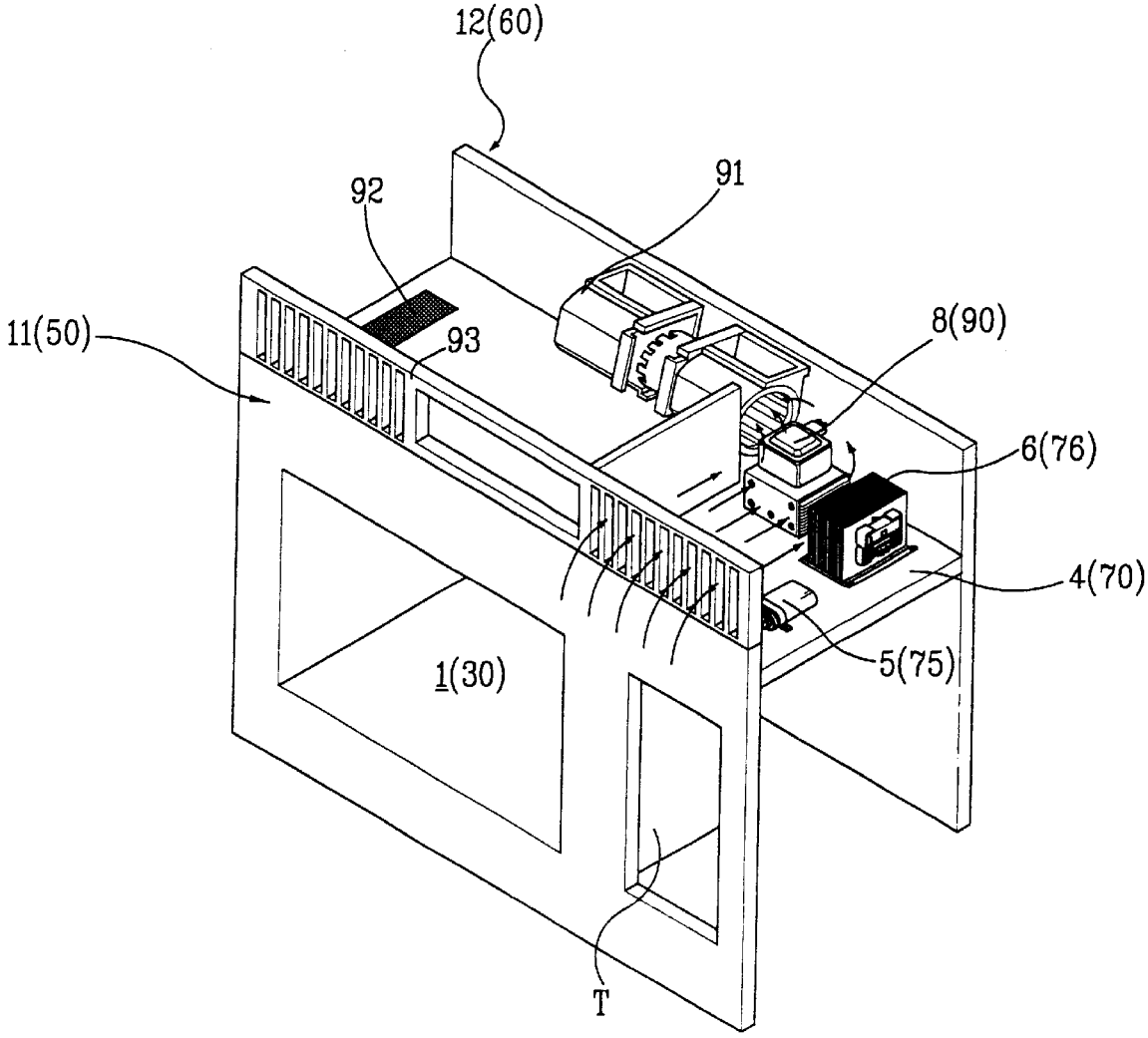

According to the first embodiment of the present invention, since the high voltage capacitor 5 and the high voltage transformer 6 are fitted at positions higher than a top surface of the cavity 1*b*, to lead the air introduced into the electric outfit room through a right side region of the vent grill 93 to the high voltage capacitor 5 and the high voltage transformer 6 to cool down the high voltage capacitor 5 and the high voltage transformer 6 before drawn into the sirocco fan at a right side of the vent motor 91 when the sirocco far at right side of the vent motor 91 is in operation as shown in FIG. 8, different form the related art, no separate cooling fan and suction guide are required in the electric outfit room 3, simplifying the electric outfit room. In the meantime, when the microwave oven serves as a ventilator for the gas oven range below the microwave oven, the electric outfit plate 4 also serves as an isolating wall for isolating the electric outfits, such as the high voltage transformer 6 and the high voltage capacitor 5, from the heat coming up from the gas oven range so that the heat does not affect the electric outfits. According to the first embodiment of the present invention, since required components are reduced, a material cost is saved, and assembly man power is reduced, to reduce an assembly time period, and a defect ratio caused by the assembly.

An electric outfit room in an OTR type microwave oven in accordance with a second preferred embodiment of the present invention will be explained, with reference to FIGS. 4–8.

Figure 6:
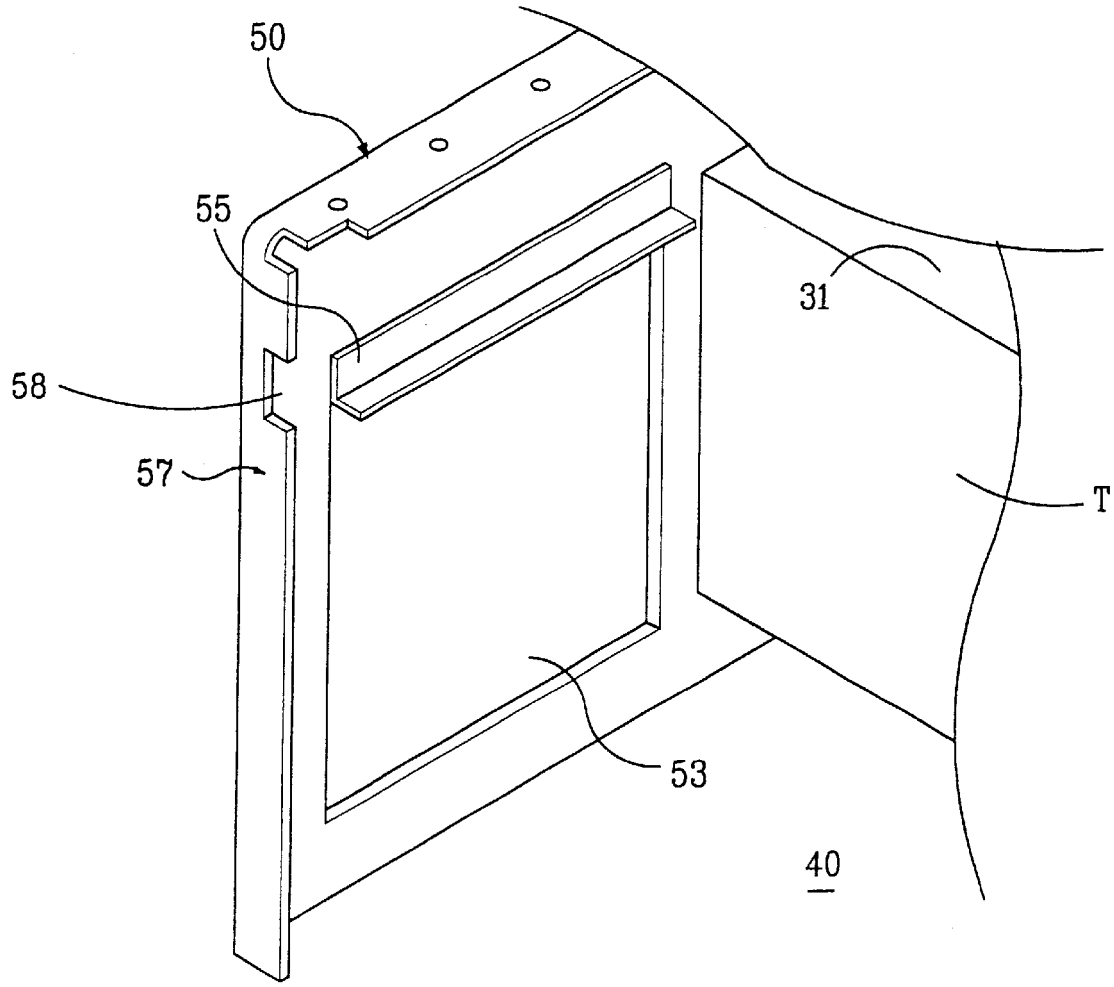
FIG. 6 illustrates a detailed perspective view of key parts in FIG. 4, for explaining fitting of a front support rail to a front plate.

As shown, a cavity 30 and an electric outfit room 40, both formed between a front plate 50 and a back plate 60, are separated by a partition wall 'T'. There is a vent motor 91 having two sirocco fans coupled at both sides thereof on a top surface 31 of the cavity in the vicinity of the back plate 60. As shown in FIG. 6, there is an opening 53 formed in a part of the front plate 50 of the electric outfit room 40 for fitting a control panel therein. There is a front supporting rail 55 of a '⌊' form at a top of the opening 53 at a height approx. the same with the top surface 31 of the cavity. The form of the front supporting rail 55 is designed to cope with a narrow space due to the opening 53, which is shown as one example. There is one end of the wave guide 80 fitted vertical to a partition wall 'T' adjacent to the vent motor 91 and the sirocco fan. The other end of the wave guide 80 has an edge surface 81 projected from the wave guide 80 body. The edge surface 81 has a fastening hole 82 formed in correspondence to the fastening hole 73 in the supporting part 72 in the electric outfit plate 70 for fastening a bolt. There is a magnetron 90 over the wave guide 80.

In the meantime, there is a front flange 57 formed along an edge of the front plate 50 having a plurality of fastening holes for fastening with the out case, for serving as a supporting part when the front plate 50 is assembled with the out case, and there is an opening 58 in a part of the front flange 57 in the vicinity of the front supporting rail 55.

Figure 7:
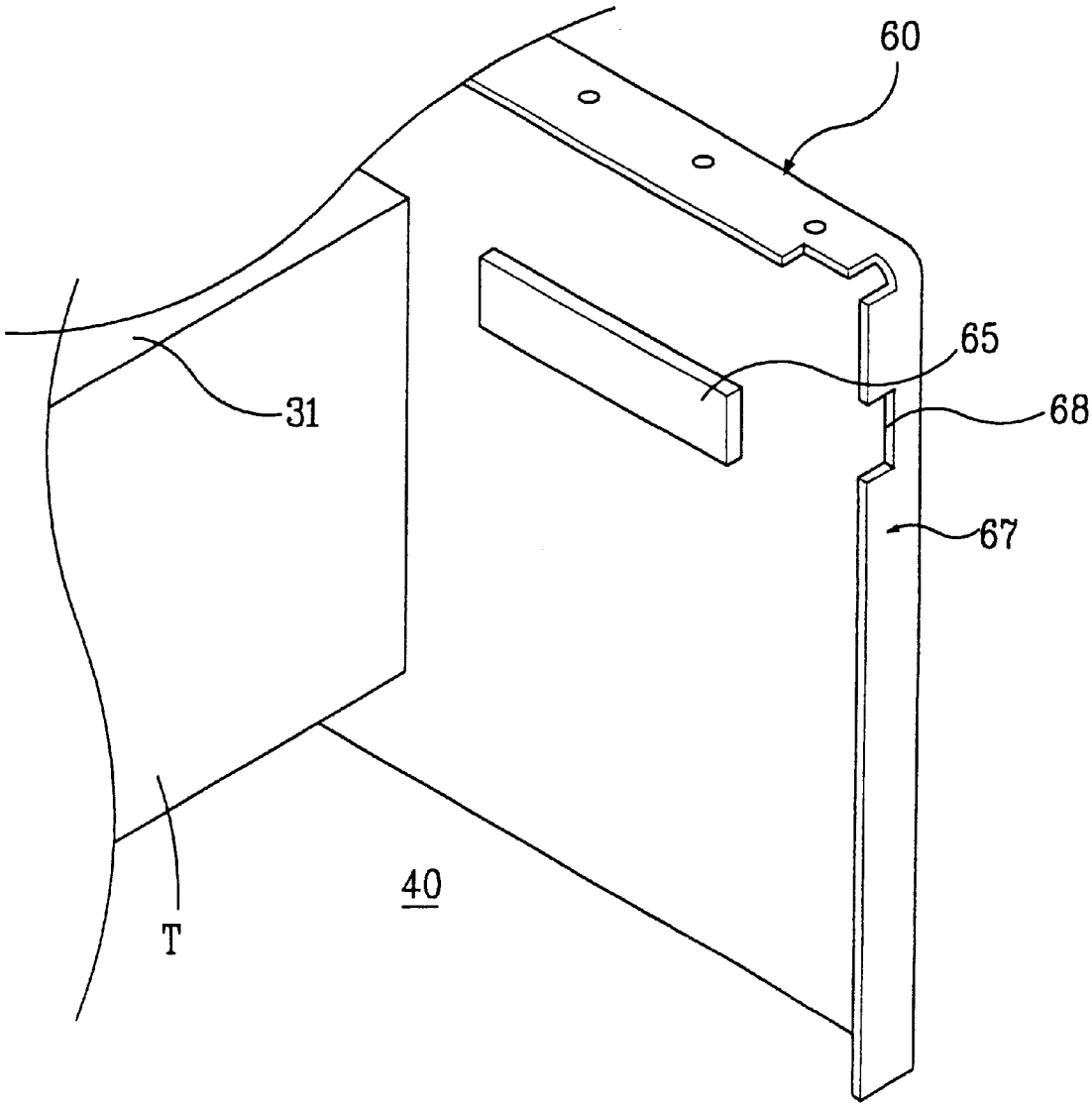
FIG. 7 illustrates a detailed perspective view of key parts in FIG. 4, for explaining fitting of a rear support rail to a back plate; and, FIG. 8 illustrates a perspective view for explaining an airflow in a microwave oven in accordance with a first or second embodiment of the present invention.

Referring to FIG. 7, there is a rear supporting rail 65 of a rectangular section fitted to the back plate 60 at a height the same with the front supporting rail 55 fitted to the front plate 50. There is back flange 67 formed along an edge of the back plate 60, and an opening 68 in the back flange 67 in the vicinity of the rear supporting rail 65.

The forms of the foregoing supporting rails 55 and 65 are embodiments of the present invention, and the forms may be changed freely as far as the supporting rails 55 and 65 serve to support the electric outfit plate 70 when the electric outfit plate 70 is slid into position in an upper part of the electric outfit room 40. For an example, the supporting rails are formed at the electric outfit plate 70, and rail grooves are formed in the front plate 50 and the back plate 60.

In the meantime, the electric outfit plate 70 having electric outfits, such as the high voltage capacitor 75 and th high voltage transformer 76, fitted thereto is inserted sliding on the supporting rails 55 and 65, and fixed at a height approx. the same with the vent motor 91.

Figure 5:
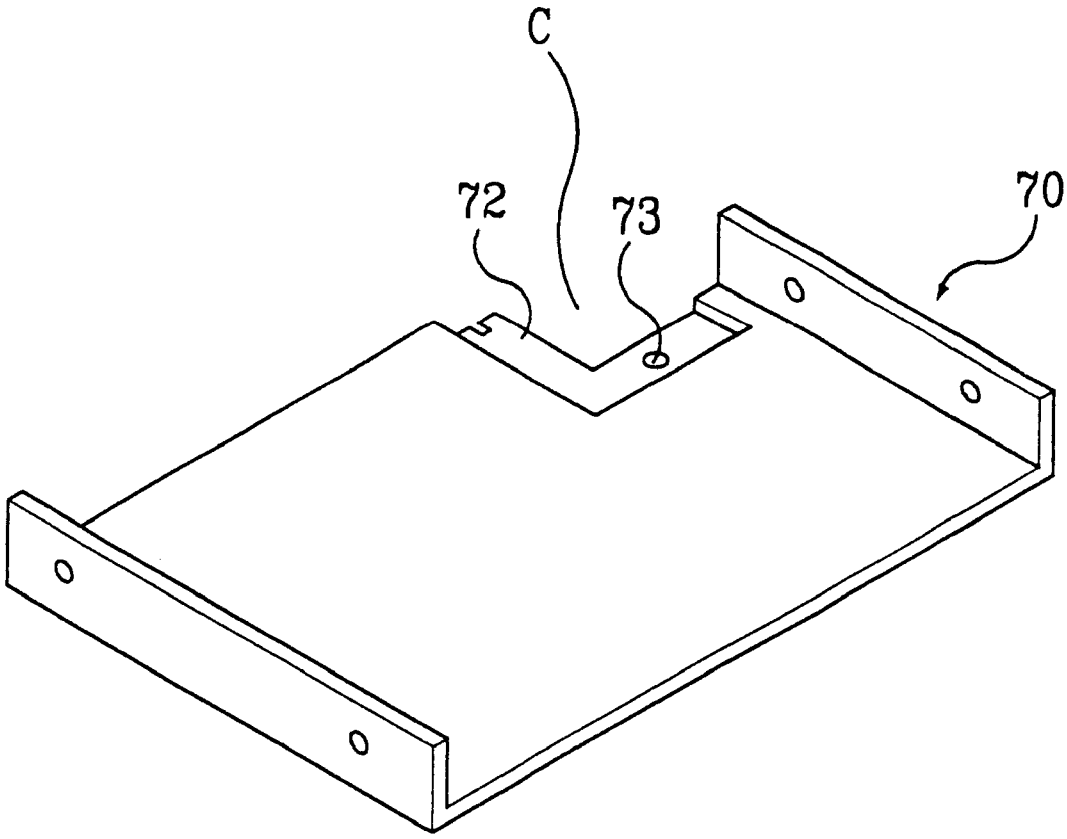
FIG. 5 illustrates a perspective view of an outfit plate in an OTR type microwave oven in accordance with a second preferred embodiment of the present invention.

Referring to FIG. 5, a part of the electric outfit plate 70 is cut out 'C' in the vicinity of the sirocco fan coupled with the vent motor at a right side thereof, and a down set supporting part 72 is formed around the cut out part 'C' for supporting the edge surface 9*a* of the wave guide 9. The down set supporting part 72 for supporting the edge surface 9*a* of the wave guide 9 has a fastening hole 73 in correspondence to the edge surface 81.

An assembly process in the electric outfit room of the microwave oven in accordance with a second preferred embodiment of the present invention will be explained.

At first, the wave guide 80 is fitted to the partition wall 'T' adjacent to the vent motor. The electric outfit plate 70 having the electric outfits, such as the high voltage capacitor 75 and the high voltage transformer 76, fitted thereto is inserted from a side of the electric outfit room 40 and fixed at a height similar to the vent motor by using the front supporting rail 55 and the rear supporting rail 65 fitted to the front plate 50 and the back plate 60. Once the electric outfit plate 70 is inserted, the supporting part 72 comes under the wave guide edge surface 81 and supports the edge surface 81, and by aligning the fastening holes 73 and 82 formed in the edge surface 81 and the electric outfit plate 70 respectively, and fastening the bolt, the wave guide 80 can be fitted securely. Finally, upon fitting the magnetron 90 to the wave guide 80, the assembly is completed.

Alike the first embodiment, in the second embodiment of the present invention too, since the high voltage capacitor 75 and the high voltage transformer 76 are fitted at positions higher than a top surface of the cavity 31, to lead the air introduced into the electric outfit room through a right side region of the vent grill 93 to the high voltage capacitor 75 and the high voltage transformer 76 to cool down the high voltage capacitor 75 and the high voltage transformer 76 before drawn into the sirocco fan at a right side of the vent motor when the sirocco fan at right side of the vent motor is in operation as shown in FIG. 8, different form the related art, no separate cooling fan and suction guide are required in the electric outfit room 3, simplifying the electric outfit room. That is, as shown in FIG. 8, the air introduced into the electric outfit room 40 from an upper part thereof through the vent grill 93 in an upper part of a front face of the microwave oven cools down the electric outfits, such as the high voltage capacitor 75 and the high voltage transformer 76, is drawn into the right side suction hole 71, and discharged to outside of the microwave oven when the vent motor 91 is in operation. In the meantime, according to the second embodiment of the present invention, when the microwave oven serves as a ventilator for the gas oven range below the microwave oven, the electric outfit plate 70 also serves as an isolating wall for isolating the electric outfits, such as the high voltage transformer 76 and the high voltage capacitor 75, from the heat coming up from the gas oven range so that the heat does not affect the electric outfits. Because the comparatively heavy electric outfit plate 70 having the electric outfits, such as the high voltage capacitor 75 and the high voltage transformer 76 and the like, fitted thereto can be fitted by pushing from a side of the electric outfit room 40 by using the supporting rails 55 and 65 formed on the front plate 50 and the back plate 60, the required work is easy. Moreover, the slide fastening of the electric outfit plate 70 and the reduction of components permits to provide a comparatively simple structure, which shortens an assembly time period. The reduced assembly process reduces defects caused by assembly.

In the meantime, in the first or the second embodiment of the present invention, the heat from inside of the cavity during the microwave oven is in operation is rejected through the discharge hole 92 in the cavity top surface 31, drawn into, and discharged from, the left side sirocco fan of the vent motor 91, and discharged outside of the microwave oven through a cleaning filter (not shown) and a left area of the vent grill 93.

The present invention has advantage in that an assembly work of the electric outfits is made easy enough to reduce a load on the worker. The reduction of components saves a material cost. The reduction of assembly process owing to comparatively simple structure relative to the related art reduces a defect ratio.

It will be apparent to those skilled in the art that various modifications and variations can be made in the electric outfit room in a microwave oven of the present invention without departing from the spirit or scope of the invention. Thus, it is intended that the present invention cover the modifications and variations of this invention provided they come within the scope of the appended claims and their equivalents.

What is claimed is:

1. An electric outfit room in a microwave oven, comprising:

a front plate;

a back plate disposed a distance from, and opposite to, the front plate;

a base plate between the front plate and the back plate;

a partition wall configured to isolate a cooking cavity;

a wave guide fixed to the partition wall;

a magnetron mounted on the wave guide; and an electric outfit plate configured to support electric components and further configured to be slid into place from a top of the microwave oven and fixed proximate to a plane substantially coincident with an upper surface of the cooking cavity.

2. An electric outfit room as claimed in claim 1, wherein the electric outfit plate comprises a front edge and a rear edge configured to be attached to the front plate and the back plate, respectively.

3. An electric outfit room as claimed in claim 1, further comprising a supporting member disposed between the front plate and the back plate and configured to support the wave guide.

4. An electric outfit room as claimed in claim 3, wherein the supporting member comprises a first end fixed to the front plate and a second end fixed to the back plate.

5. An electric outfit room as claimed in claim 4, wherein the supporting member comprises a first hole and the wave guide comprises a second hole and the first hole and the second hole are configured to receive a fastening a bolt for fixing the wave guide to the supporting member.

6. An electric outfit room in a microwave oven, comprising:

a front plate;

a back plate disposed a distance from, and opposite to, the front plate defining a cooking cavity with an upper surface therebetween;

a base plate between the front plate and the back plate;

a partition wall configured to isolate the cooking cavity from an electric outfit room;

a wave guide fixed to the partition wall;

a magnetron mounted on the wave guide;

a front support rail and a rear support rail mounted on the front plate and the back plate, respectively;

an electric outfit plate supported on the front support rail and rear support rail and disposed on a plane substantially coincident with the upper surface of the cooking cavity, wherein the electric outfit plate is configured to receive electric components and is further configured to be inserted into place from a side of the microwave oven by sliding on the front support rail and the rear support rail.

7. An electric outfit room as claimed in claim 6, wherein the electric outfit plate comprises;

a cut out area in a corner of the electric outfit plate, and a down set supporting part around the cut out area configured to support an edge of the wave guide.

8. An electric outfit room as claimed in claim 7, wherein the down set supporting part comprises a fastening hole corresponding to a fastening hole formed in an edge of the wave guide and configured for fastening the electric outfit plate to the wave guide.

9. An electric outfit room as claimed in claim 6, wherein the front supporting rail is fixed to the front plate of the cavity and the rear supporting rail is fixed to the back plate of the cavity.

10. An electric outfit room in a microwave oven, comprising:

a front plate and a back plate, wherein the front plate and the back plate are disposed parallel to one another and are separated by a prescribed distance;

an electric outfit plate configured to receive electrical components and to slide into a prescribed position between the front plate and the back plate; and a supporting member attached to the front plate and the back plate and configured to support a waveguide, and wherein the front plate and the back plate each comprise a top edge, and the electric outfit plate slides into the prescribed position by passing the respective top edges of the front plate and the back plate, and wherein the supporting member comprises a fastening hole, and the waveguide comprises a corresponding fastening hole, wherein the waveguide is configured to be fastened to the supporting member by a fastener passing through each respective fastening hole, and wherein the front plate and the back plate are configured to support the electric outfit plate.

11. The electric outfit room of claim 10, wherein the electric outfit plate is configured to be removably fixed in the prescribed position.

12. The electric outfit room of claim 10, further comprising a cooking chamber comprising a top surface, wherein the prescribed position of the electric outfit plate is proximate to the top surface of the cooking chamber, and to the side of the cooking chamber.

13. The electric outfit room of claim 12, wherein the cooking chamber further comprises a side surface, wherein the prescribed position of the electric outfit plate is proximate to the side surface of the cooking chamber.

14. The electric outfit room of claim 10, wherein the electric outfit plate comprises a cutout.

15. The electric outfit room of claim 14, wherein the cutout is configured to support a waveguide.

16. The electric outfit room of the claim 15, wherein the electric outfit plate comprises a fastening hole proximate to the cutout, and the waveguide comprises a corresponding fastening hole, and wherein the waveguide is configured to be fastened to the electric outfit plate by a fastener passing through each respective fastening hole.

17. An electric outfit room in a microwave oven, comprising:

a front plate and a back plate, wherein the front plate and the back plate are disposed parallel to one another and are separated by a prescribed distance; and an electric outfit plate configured to receive electrical components and to slide into a prescribed position between the front plate and the back plate, and wherein the electric outfit plate comprises a cutout, and wherein the cutout is configured to support a waveguide, and wherein the electric outfit plate comprises a fastening hole proximate to the cutout, and the waveguide comprises a corresponding fastening hole, and wherein the waveguide is configured to be fastened to the electric outfit plate by a fastener passing through each respective fastening hole, and wherein the front plate and the back plate are configured to support the electric outfit plate.

18. The electric outfit room of claim 10, wherein the front plate and the back plate each comprise side edges, and the electric outfit plate slides into the prescribed position by passing the side edges of the front plate and the back plate.

19. The electric outfit room of claim 18, further comprising a front supporting rail attached to the front plate and rear supporting rail attached to the back plate, wherein the front supporting rail and the rear supporting rail are configured to support the electric outfit plate in the prescribed position.

20. The electric outfit room of the claim 19, wherein the electric outfit plate is configured to slide into the prescribed position along the front supporting rail and the rear supporting rail.

* * * * *